United States Patent [19]

Wisting

[11] Patent Number: 5,069,197

[45] Date of Patent: Dec. 3, 1991

[54] FUME HOOD

[76] Inventor: Walter L. Wisting, 125 Squires Glen Rd., Madison, Conn. 06443

[21] Appl. No.: 588,163

[22] Filed: Sep. 26, 1990

[51] Int. Cl.[5] ..... F24C 15/20

[52] U.S. Cl. ..... 126/299 E; 126/299 R; 126/299 D; 454/67

[58] Field of Search ..... 126/299 E, 299 R, 299 D; 98/115.1

[56] References Cited

U.S. PATENT DOCUMENTS

| | | | |
|---|---|---|---|
| 907,633 | 12/1908 | Narowetz . | |
| 2,090,466 | 8/1937 | Bichowsky . | |
| 2,392,601 | 1/1946 | Long . | |
| 2,943,290 | 7/1960 | Hoover . | |
| 3,266,224 | 8/1966 | Feretti . | |
| 3,370,404 | 2/1968 | Leeper . | |
| 3,616,744 | 11/1971 | Jensen . | |
| 3,731,462 | 5/1973 | Costarella . | |
| 3,866,333 | 2/1975 | Sarukahanian . | |
| 3,876,399 | 4/1975 | Saponaro . | |
| 3,893,831 | 7/1975 | Doane . | |
| 4,071,019 | 1/1978 | King | 126/299 E |
| 4,351,652 | 9/1982 | Wisting | 126/299 E X |
| 4,822,385 | 4/1989 | Strege et al. | 126/299 E X |

FOREIGN PATENT DOCUMENTS 1231710 5/1971 United Kingdom .

*Primary Examiner*—Larry Jones

*Attorney, Agent, or Firm*—Robert H. Montgomery

[57] ABSTRACT

A hood adapted to remove contaminants from incoming airflow comprising a housing member having top, front, back and side walls, and defining a lower liquid sump, and an upper exhaust opening in the top wall, an inlet opening defined in the front wall of the housing member the front wall is inclined inwardly and downwardly, a partition extends between the side walls downwardly from the front wall and has a free end defining an air passage with the back wall leading to a large volume upper portion of the housing, a screen having openings therein extends between the side walls and downwardly from the free end of the partition into the sump, the partition has a dam on the free end thereof having a horizontal upper edge, liquid will overflow the dam on the partition and move across the openings in the screen to the sump, whereby air passing into the inlet opening passes through the liquid moving across the screen and then through the liquid moving across the screen and then through an agglomeration of liquid in the upper housing, a removable liquid header is mounted to an extends across the top wall and has a plurality of spaced apart nozzles extending through openings in the top wall into the housing member above the front wall liquid introduced into the header exits through the nozzles into the upper part of the housing and is agglomerated as the airflow enters the upper part of the housing.

12 Claims, 2 Drawing Sheets

FUME HOOD

FIELD OF THE INVENTION

This invention relates to fume hoods which are adapted to remove grease and any other contaminants from an air flow.

BACKGROUND OF THE INVENTION

In restaurant kitchens fume hoods are necessary to remove cooking odors, especially over deep fat and grease frying equipment where the fumes include a considerable amount of contaminants in the exhaust.

Prior art systems include an exhaust fan and a hood system for drawing air from over a cooking surface into the hood and out an outlet. They sometimes include screens or filters for collecting the grease. Since such screens require considerable cleaning, the preferred system has been to let the grease be eliminated from the air by having it stick to inside surfaces of the hood interior surfaces. This not only is an inefficient and unsatisfactory method of removing the grease, but also, because of the heat involved, the grease tends to bake onto the inner surface of the hood and is difficult to remove. This also creates a possibility of fire. In fact, most fire codes and underwriters laboratories require a spring-loaded fire damper to close the top exit of the hood in the event of fire.

In systems such as these, the inside of the hood is cleaned when the hood is not being operated by using one or more spray nozzles permanently mounted inside the duct to scrub down the baked on grease. This can only be done when the exhaust fan is turned to off.

A variation on this prior art technique is a system in which one or possibly more spray nozzles are mounted somewhere within the hood. These operations conducted while the hood is in operation have the purpose of cooling the air so that better condensation of the grease on the sides of the hood will be obtained. Normally, this provides only nominal air-water contact so only a small amount of grease will actually be removed by the water. To the extent that grease removed by the water could cause clogging unless there is a periodic detergent cycle in which a fan is turned off; otherwise the grease may be carried in water droplets and stick to the ducts and fan blade that moves air through the hood.

"Waterfalls" have been used in industrial air scrubbers, in association with other steps, but normal waterfalls are subject to being "punctured" by an air stream, i.e., develop holes or voids in the waterfall permitting much of the contaminated air to pass through the holes without contacting the water. See, for example, the patents to Fisher, U.S. Pat. Nos. 2,259,032 and 2,354,674, and McIllvaine U.S. Pat. No. 3,077,714.

U.S. Pat. No. 4,351,652 provides a very efficient system of grease removal from an air stream. However, it has been determined that the spray nozzles within the housing tend to become contaminated and clogged with minerals in the water and coated with grease over a period of time and it is time consuming to open the hood to clean the nozzles, and one does not know when these nozzles plug up.

Accordingly, the present invention provides a new and improved fume hood which effectively removes grease and other contaminants from an air stream and which is easily maintainable without opening the fume hood for removable and/or cleaning of inside nozzles or the inside walls of the hood, or with visual contact of the water fall to insure continuing efficient extraction of the grease.

SUMMARY OF THE INVENTION

Briefly stated, the invention in one form thereof comprises a hood adapted to remove contaminants from incoming airflow and adapted to be positioned above or adjacent to a cooking apparatus and comprises a housing member having top, front, back and side walls, and defining a lower liquid sump, an upper exhaust opening in the top wall, and an inlet opening defined in the front wall of the housing member above the defined sump. The front wall is inclined inwardly and downwardly, a partition extends between the side walls from the front wall and has a free end defining an air passage with the back wall leading to a large volume upper portion of the housing. The partition is inclined downwardly toward its free end toward the sump, a screen having openings therein extends between the side walls and downwardly from the free end of the partition into the sump, the partition has a dam on the free end thereof having a horizontal upper edge, the liquid will overflow the dam on the partition and fall in a sheet and move across the screen and the openings in the screen to the sump, whereby air passing into said inlet opening and said housing member passes through the liquid moving across the openings in the screen and then through an agglomeration of liquid in the upper housing. A removable liquid header is mounted to an extends across the top wall and has a plurality of spaced apart nozzles extending into the housing member above the front wall and partition. Liquid is introduced into the header and exits through the nozzles into the upper part of the housing and is mixed and agglomerated in the turbulence of the airflow as the airflow enters the upper part of the housing and the velocity thereof contacting the air flow therein and removing grease and any other particles from the air flow. Thereafter, the liquid then falls into the sump directly or predominantly in a sheet over the partition dam and is recirculated from a reservoir below the sump to the header.

DETAILED DESCRIPTION OF A PREFERRED EMBODIMENT OF THE INVENTION

Figure 1:
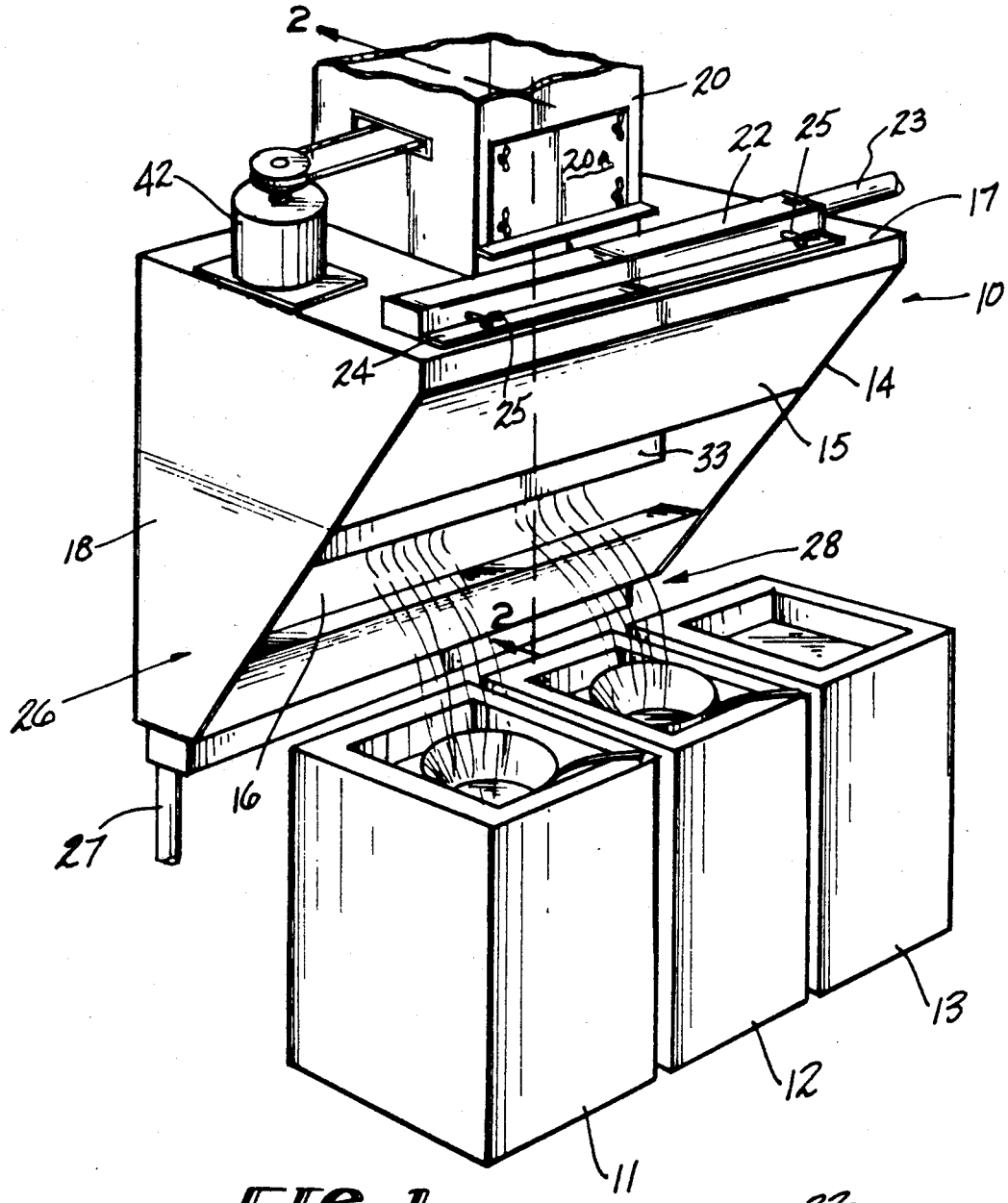
FIG. 1 is a perspective view of a fume hood system embodying the invention mounted above three deep fat frying units.

As shown in perspective in FIG. 1 a fume hood 10 is indicated as being wall mounted with three deep fat frying units 11, 12, and 13 positioned there beneath. While wall mounting mounting may be preferable it is to be understood that a suitable base unit (not shown) may be utilized to support the fume hood 10 above the source of the fumes, in this case, the deep fat frying units 11, 12 and 13.

The fume hood comprises a housing 14 having a downwardly integrally sloping front wall 15. An opening 16 is defined in the front wall as hereinafter more fully described to permit entrance of fumes from the units 11, 12, and 13 into the interior of housing 14.

Figure 2:
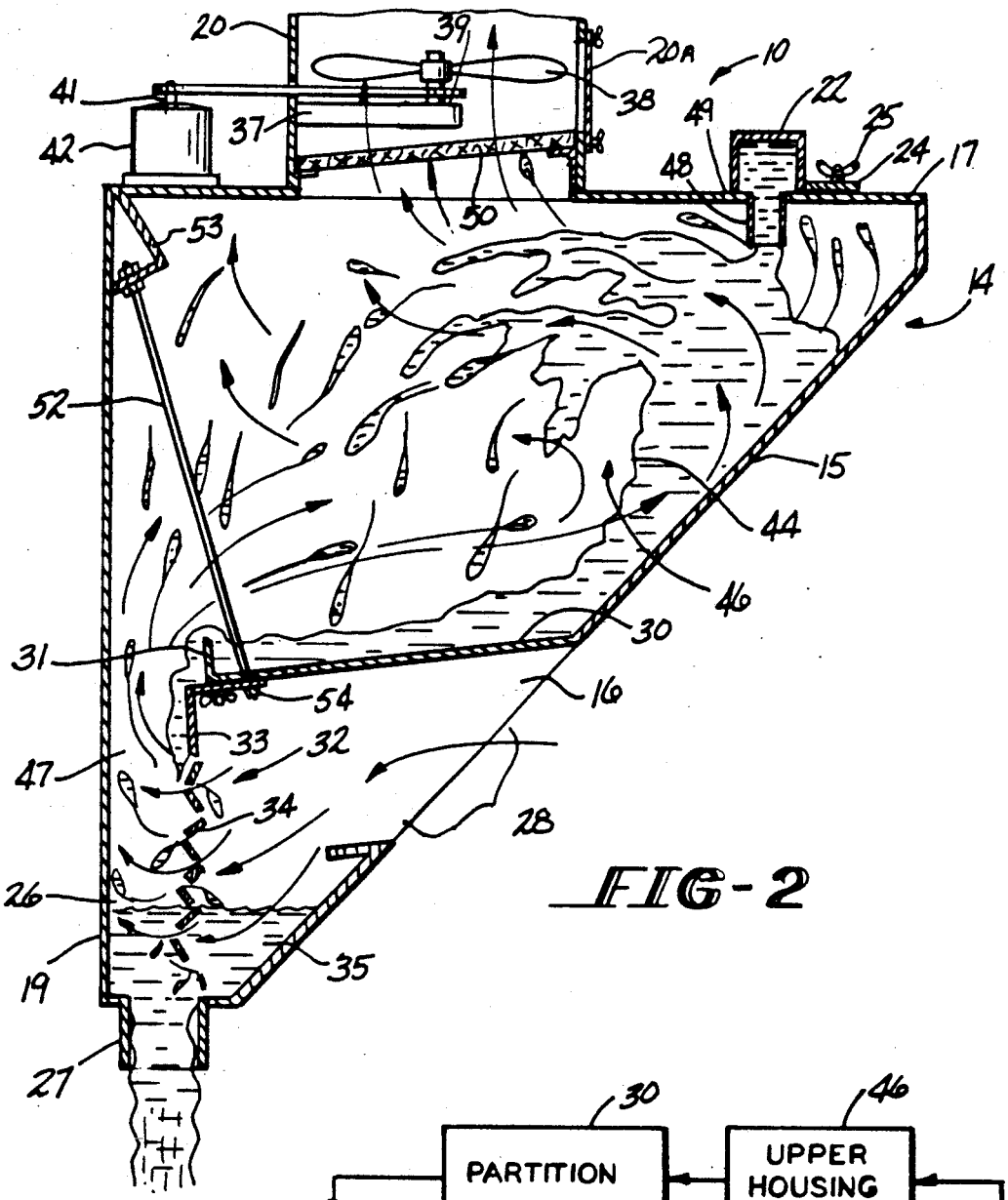
FIG. 2 is a sectional view seen in the plane of lines 2—2 of FIG. 1.

The housing 14 further has a top wall 17, side walls 18 (only one shown) and a back wall 19 as shown in FIG. 2.

A duct 20 extends from the upper wall 17 and will include therein water extracting apparatus and also a fan or blower for pulling air though the unit. A removable door 20*a* is provided for access to the interior of duct 20. The moisture extractor preferably comprises a plurality of angled members with legs overlying each other which define a tortuous path of air exiting the fume hood and providing surfaces upon which any grease particles or any other contaminants may impinge and be removed from the air stream. Such structures are well known.

Mounted on top wall 17 above front wall 15 is a liquid header 22 of rectangular cross section having an inlet pipe 23.

As will hereinafter be described header 22 has nozzles thereon (not shown in FIG. 1) extending through openings in top wall 17. These nozzles are preferably one half inch in diameter and have the ability to pass particles three eights of an inch or larger without plugging.

Header 22 has a lower flange 24 thereon bolted or otherwise fastened to top wall 17 by thumb bolts or screws 25 and adapted to be easily removable for maintenance on the nozzles or jets, as will hereinafter be described, from the outside of the apparatus.

Housing 14 contains a lower portion indicated by the reference numeral 26 which will be termed a sump area or volume and one or more lower drain pipes 27 may lead from the sump to a reservoir as hereinafter described.

Further as hereinafter described a fan or blower mounted in extractor 20 will draw fumes up from the cookers 11, 12, and 13 as shown by the arrows generally indicated as 28.

Reference is now made to FIG. 2 which is a cross section seen in the plane of lines 2—2 of FIG. 1.

As will hereinafter be discussed the air flow through housing 14 is shown by the arrows while the shaded portion shows the pattern of the major distribution of the liquid within housing 14. The liquid within housing 14 is a water-detergent mixture formulated to remove grease particles from the air stream and wash the inside walls of housing 14.

Front wall 15 has integral therewith or alternatively connected thereto a downwardly sloping partition 30 having an upstanding free end 31 providing a dam for water thereon.

Attached towards the free end of partition 30 is a screen assembly 32 which may also be referred to as an impinger or water guide. Screen assembly 32 may comprise an angle member 33 supporting a screen 34 thereon which extends into a sump 35. A sump 35 as will hereinafter be described collects a liquid which is further recirculated to header 22.

The screen or impinger 34 is preferably as shown in U.S. Pat. No. 4,351,652, the disclosure of which is incorporated herein by reference. The screen 34 comprises expanded sheet metal which is so formed that the water will move down the screen and create an almost impervious screen of water to the airflow coming through as designated by the arrows 28. The screen 34 is angled slightly inwardly toward backwall 19 from top to bottom to present a complete screen of liquid to the incoming air flow.

In duct 20 is a support 37 in which is journalled the shaft of a fan or blower 38 having a pulley 39 thereon which is driven by a belt 40 driven from a pulley 41 on a motor 42 mounted to the top wall 17 of housing 14.

In FIG. 2, motor 42 is shown as displaced from the position shown in FIG. 1 for purpose of clear illustration.

It may be seen from FIG. 2 that the back wall 19 of housing 14 and the screen assembly 32 define a relatively narrow passage for air above sump 35 which after passing dam 31 will turbulently expand in volume, and decrease in velocity. As the air expands it will move towards front wall 15 in a turbulent fashion and will be engaged by an agglomeration of water which in its highest density is shown in outlines 44 which are shaded. While not shown in the drawings there will be created a mist in the upper portion 46 of housing 14 which mist of water will also act to capture grease particles which have not previously been captured as they move through passage 47. This mist will contact the back and side walls of housing 14 and wash down the inside walls towards partition 30 and sump 35.

This pattern of water has been observed from placing a transparent end wall on the housing 14.

As the liquid exits through the nozzles 48 extending through openings 49 in top wall 17 it is engaged by the air flow and the air flow tends to distribute the liquid in the upper porition 46 of housing 14. The liquid will capture the grease particles and other contaminants from the air flow 28 entering opening 16 and passing through the screen of water on screen assembly 32. The air flow moving through the upper portion of the housing 46 will pass through an extractor 50.

The airflow through screen 32 tends to strip the water-detergent mixture and carry it up to the center of the hood. The air flow continues towards the front wall 15 of hood 14 stripping the water-detergent mixture fed from header 22. This stripped water-detergent mixture carries to the center of the upper portion of the hood where all water droplets collide with kinetic energy with grease particles and any other contaminants and carries them to the lower sump. This contaminated water detergent returns to a water treatment system and then is pumped back to header 22 as hereinafter described.

The header 22 together with its flange 24 may be placed on top a sealing means to insure that there is no leakage of liquid on to top wall 17. However, with the nozzles extending through openings defined therefor in top wall 17 such sealing means is not considered necessary. When the fume hood is shut down, due to negative pressure inside the hood, the header together with all the nozzles thereon may be easily removed from top wall 17 by loosening and removal of the fastening devices 25. Then the nozzles 48 may be easily cleaned from outside the housing to remove any accumulation of grease or other contaminants that were in the air stream 28.

Figure 3:
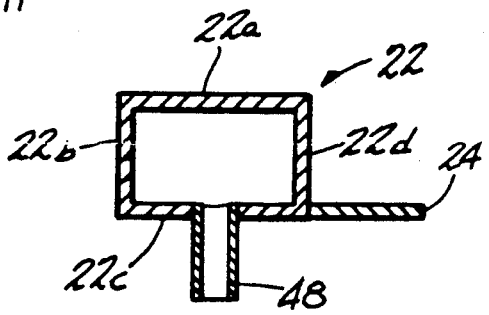
FIG. 3 is an enlarged cross section of the header shown in FIG. 2.

An enlarged cross sectional view of header 22 is shown in FIG. 3. Header 22 is preferably an extrusion and comprises a top wall 22*a*, side walls 22*b*, and a bottom wall 22*c*. The flange 24 is attached to one of side walls 22*b* as by welding. Apertures are defined in bottom wall 22*c* and receive nozzles 48 therein which are preferably uniformly spaced apart and received in mating openings in top wall 17 of fume hood 14. The header 22 may also be made of circular cross section with nozzles attached together with a flange 24 attached. However, for manufacturing purposes the rectangular cross-section header is preferred. This provides an easily removable header where the nozzles 48 may be easily cleaned.

Partition 30 may be adjusted and leveled from the exterior of fume hood 14 by virtue of one or more rods 52. The upper end of rod(s) 52 is captured in an angle member 53 attached to the back upper portion of hood 14. Rod(s) 52 extend through portion 30 and threadably receive an adjusting nut(s) 54 thereon. The adjusting nut(s) 54 are accessible from the outside of fume hood 15 and permit horizontal leveling of partition 30 and dam 31 thereon from the exterior of the fume hood.

Access may be had to extractor 50 and blower or fan 38 through removable door 38 for maintenance or cleaning. Thus it may be seen that there is no requirement for opening or disassembly of the hood for purposes of maintenance. The header 22 may be removed for inspection periodically and cleaning of the nozzles, if necessary.

Figure 4:
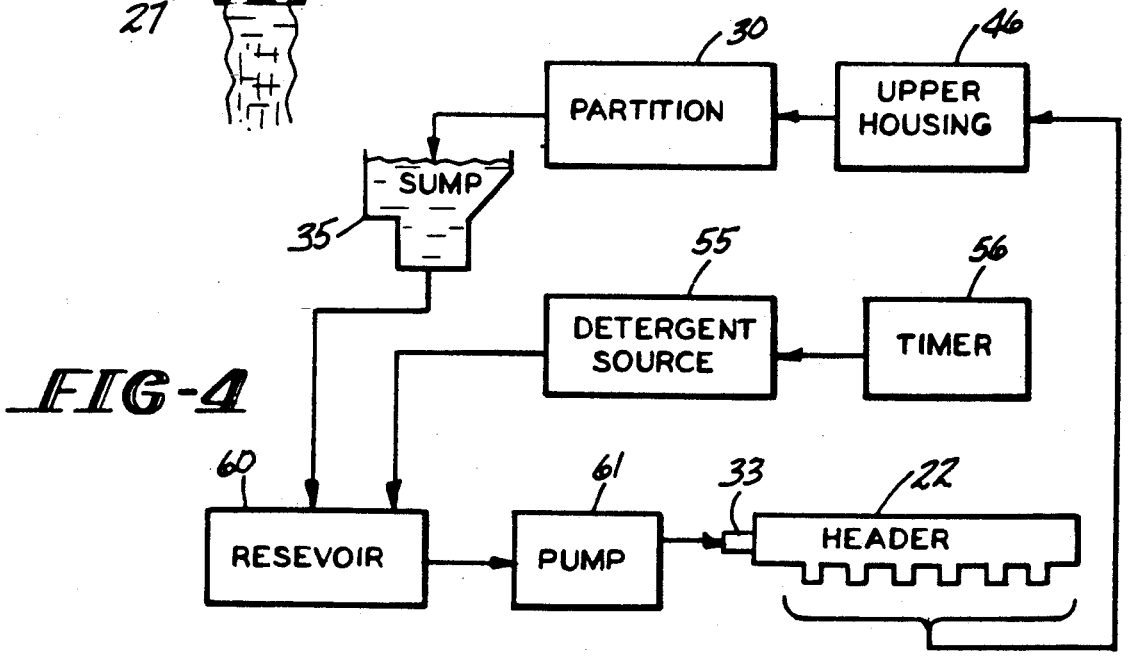
FIG. 4 is a block diagram showing liquid flow through the system.

Reference is now made to FIG. 4 which in block form shows the liquid circulation through the housing 14. The liquid in sump 35 falls through conduit(s) 27 to a reservoir 60 from whence it is pumped by a pump 61 into inlet 23 into header 22 thereafter the liquid flow is into upper housing 46 through nozzles 48 then to the partition 30 and hence over the dam 31 and down along screen 34 which is slightly slanted inwardly to guide the flow of liquid therefore. It will be noted that the screen 34 extends partially into the liquid level in sump 35.

The pump and the flow rate of the liquid is so set that there is a fall of liquid over the dam 31 which will provide sufficient water over screen 34. Additionally, the system may include a detergent source 62 which is periodically actuated by a timer 63 to add detergent to reservoir 60. Alternatively, a sensor (not shown) could be placed on either the sum 35 or reservoir 60 to detect any predetermined characteristics of the liquid and actuate detergent source 62 to add additional detergent to liquid in the reservoir.

The timer is used on the basis of time and operation of the system and experience as to when it is necessary to add additional detergent to the liquid.

It may thus be seen that the objects of the invention set forth, as well as those made apparent from the foregoing description, are efficiently attained. While a preferred embodiment of the invention has been set forth for purposes of disclosure, modifications to the disclosed embodiment of the invention, as well as other embodiments thereof, may occur to those skilled in the art. Accordingly, the appended claims are intended to cover all embodiments of the invention and modifications to the disclosed embodiment which do not depart from the spirit and scope of the invention.

I claim:

1. A hood adapted to remove contaminants from incoming airflow and adapted to be positioned above a cooking apparatus compromising a housing member, said housing member having top, front, back and side walls, and defining a lower liquid sump, an upper exhaust opening in said top wall, an inlet opening defined in the front wall of said housing member above said defined sump, said front wall being inclined inwardly and downwardly, a partition extending between said side walls from said front wall and having a free end, said partition being inclined downwardly toward its free end, the free end of said partition being above sump, said a screen having openings therein extending between said side walls and from the free end of said partition into said sump, said screen, the lower end of said partition and said back wall defining an air passage into an upper portion of said hood, said partition having means on the free end thereof defining a liquid dam having a horizontal upper edge, a liquid header means mounted to and extending across said top wall and having a plurality of spaced apart nozzles extending into said housing member above said front wall and said partition, said header means being external of said top wall, means for drawing liquid from said sump and delivering the liquid to said header whereby the liquid will overflow the dam on said partition and fall in a sheet and move across the openings in said screen to said sump, whereby air passing into said inlet opening and through said housing member passes through the liquid moving across the openings in said screen and then through an agglomeration of liquid from said nozzles, and means for drawing air from said inlet opening through said housing and said exhaust opening.

2. The hood of claim 1 where said header is removably mounted to said top wall.

3. The hood of claim 1 where said header is rectangular in cross section and rests on said top wall.

4. The hood of claim 1 further including means on the outside of said housing for leveling the upper edge of said dam.

5. The hood of claim 1 wherein said header has a flange thereon which is removably fastened to said top wall.

6. The hood of claim 1 where said sump is connected to a reservoir for discharge of liquid thereto and the liquid is recirculated to said header.

7. The hood of claim 1 where said header is removably mounted to said top wall,

8. The hood of claim 1 where said header is rectangular in cross section and rests on said top wall.

9. The hood of claim 1 further including means on the outside of said housing and extending to said upper portion for leveling the free end of said partition.

10. The hood of claim 1 wherein said header has a flange thereon which is removably fastened to said top wall.

11. The hood of claim 1 where said sump is connected to a reservoir for discharge of liquid thereto and the liquid is recirculated to said header.

12. A hood adapted to remove contaminants from incoming airflow and adapted to be positioned above a cooking apparatus compromising a housing member, said housing member having top, front, back and side walls, and defining a lower liquid sump, an upper exhaust opening in said top wall, an inlet opening defined in the front wall of said housing member above said defined sump, said front wall being inclined inwardly and downwardly, a partition extending between said side walls from said front wall and having a free end, said partition being inclined downwardly toward its free end, the free end of said partition being above said sump, a screen having openings therein extending between said side walls and from the free end of said partition into said sump, said screen, the lower end of said partition and said back wall defining an air passage into an upper portion of said hood, a liquid header means mounted to and extending across said top wall and having a plurality of spaced apart nozzles extending into said housing member from said header above said front wall and said partition, said header means being external of said top wall, means for drawing liquid from said sump and delivering the liquid to said header whereby the liquid will overflow the free end of said partition and fall in a sheet and move across the opening in said screen to said sump, whereby air passing into said inlet opening and through said housing member passes through the liquid moving across the openings in said screen and then through an agglomeration of liquid from said nozzles, and means for drawing air from said inlet opening through said housing and said exhaust opening.

* * * * *

UNITED STATES PATENT AND TRADEMARK OFFICE

CERTIFICATE OF CORRECTION

PATENT NO. : 5,069,197
DATED : December 3, 1991
INVENTOR(S) : Walter L. Wisting

It is certified that error appears in the above-identified patent and that said Letters Patent is hereby corrected as shown below:

Column 4, Line 28, delete "porition" and substitute therefor -portion-.

Signed and Sealed this

Twenty-seventh Day of April, 1993

*Attest:*

MICHAEL K. KIRK

*Attesting Officer*

*Acting Commissioner of Patents and Trademarks*